US008807607B2

(12) United States Patent
Glickman

(10) Patent No.: US 8,807,607 B2
(45) Date of Patent: Aug. 19, 2014

(54) LOCKING DEVICE, PARTICULARLY FOR DOUBLE-HUNG WINDOWS

(75) Inventor: Joel I. Glickman, Jupiter, FL (US)

(73) Assignee: Rodon Limited Partnership, Hatfield, PA (US)

( * ) Notice: Subject to any disclaimer, the term of this patent is extended or adjusted under 35 U.S.C. 154(b) by 217 days.

(21) Appl. No.: 13/565,431

(22) Filed: Aug. 2, 2012

(65) Prior Publication Data

US 2014/0035298 A1 Feb. 6, 2014

(51) Int. Cl.
*E05C 3/04* (2006.01)

(52) U.S. Cl.
USPC ..... 292/241; 292/DIG. 7; 292/DIG. 20

(58) Field of Classification Search
USPC ..... 292/241, DIG. 7, DIG. 20, DIG. 33, 292/DIG. 35
See application file for complete search history.

(56) References Cited

U.S. PATENT DOCUMENTS 4,736,972 A 4/1988 Mosch
5,110,165 A * 5/1992 Piltingsrud ..... 292/242
5,161,839 A * 11/1992 Piltingsrud et al. ..... 292/241
5,741,032 A 4/1998 Chaput
6,070,919 A * 6/2000 Finkelstein ..... 292/111
6,568,723 B2 5/2003 Murphy et al.
6,817,142 B2 * 11/2004 Marshik ..... 49/449
6,871,886 B2 * 3/2005 Coleman et al. ..... 292/241
7,665,775 B1 * 2/2010 Miller et al. ..... 292/240
7,963,577 B2 * 6/2011 Wolf ..... 292/241
8,567,830 B2 * 10/2013 Liang et al. ..... 292/240

* cited by examiner

*Primary Examiner* — Mark Williams
(74) *Attorney, Agent, or Firm* — St. Onge Steward Johnston & Reens LLC

(57) ABSTRACT

A sash lock mechanism of all-plastic construction incorporating a plastic detent spring arrangement having operating characteristics equal or superior those of conventional metallic springs while providing a more economical manufacture and assembly. The detent spring is of closed rectangular form, with inwardly bowed side elements positioned to act on opposite sides of a detent cam positioned between them, and connected at their ends by integral end and corner elements. The end and corner elements are closely confined against outward movement, causing the inwardly bowed side elements to be significantly more resistant to outward displacement by the detent cam when operating the lock. The arrangement provides a superior "feel" and snap-action effect than expected from all-plastic detent mechanisms for the purposes intended.

12 Claims, 3 Drawing Sheets

LOCKING DEVICE, PARTICULARLY FOR DOUBLE-HUNG WINDOWS

FIELD OF THE INVENTION

The present invention relates to sash locks, commonly utilized in connection with double-hung windows to lock upper and lower sashes in a closed position, and more particularly to an improved form of sash lock, formed of plastic material and which is of a highly simplified and economical construction while providing superior performance.

BACKGROUND OF THE INVENTION

Conventional sash locks for double hung windows typically are formed in two principal parts, a keeper part that is fixed to the upper sash and a locking part that is fixed to the lower sash. The locking part includes a housing mounting a rotatable locking cam and an operating lever to rotate the locking cam between "locked" and "unlocked" positions. In the "locked" position, the locking cam engages the keeper part and prevents opening movement of the two sashes. In the "unlocked" position, the locking cam is retracted into the housing, allowing the sashes to be opened and closed. The Mosch U.S. Pat. No. 4,736,972 is representative of such devices.

For a time, sash locks were made entirely of metal. More recently, however, there has been an effort to convert to plastic materials, which are lighter in weight and less expensive. The Piltingsrud et al U.S. Pat. No. 5,161,839, for example, utilized a glass-filled nylon material to form a positioning spring to retain the locking cam in its "locked" and "unlocked" positions. In the Murphy et al U.S. Pat. No. 6,568,723 most of the parts of the sash lock were constructed using glass-filled polypropylene and/or glass-filled nylon, while forming the locking cam itself of metal, preferably zinc. The Chaput U.S. Pat. No. 5,741,032 and the Miller et al U.S. Pat. No. 7,665,775 are examples of sash lock devices formed entirely of plastic material.

Heretofore, at least certain of the sash lock manufacturers have felt the need to utilize metallic detent springs, rather than plastic springs, in otherwise all-plastic sash lock devices, in order to provide a strong and long-lasting detent mechanism for retaining the sash locks in their operative "lock" and "unlock" positions and also to provide a strong snap-action effect during movement of the locking cam from one position to the other. However, the use of metallic detent springs complicates the manufacturing and assembly operations and otherwise adds unwanted cost to the product.

SUMMARY OF THE INVENTION

The present invention is directed to an improved and simplified form of all-plastic sash lock which is characterized particularly by a unique and highly effective plastic detent spring arrangement capable of securely retaining the sash lock in its respective "lock" and "unlock" positions and also of providing a strong and noticeable snap-action effect such that the locking device provides the desired "feel" and also assures a secure operational positioning of the locking cam. To this end, the invention incorporates a unique form of detent spring comprised of an engineering plastic material, such as Celcon®, and is formed in a closed, preferably generally rectangular shape. The lock housing is provided internally with a unique confinement structure for receiving and positioning the spring and restricting movement of certain portions thereof in a manner which significantly enhances the action of the plastic spring. The form and structure of the spring, in cooperation with its confining structure greatly enhances the over-centering snap-action of the device and altogether eliminates the need or desire for the use of metallic springs to achieve the results desired.

When installed in the confining structure of the lock housing, the spring engages and surrounds a detent cam which, in the illustrated and preferred form of the invention, is formed on an upper surface of the main locking cam. The detent cam includes displacement surfaces which, when the locking cam is rotated between "lock" and "unlock" positions, progressively displace portions of the detent spring, and then allow them to return toward normal positions, as the locking cam rotates through a neutral position and moves toward a final "lock" or "unlock" position.

In the mechanism of the invention, the detent spring preferably is formed with inwardly bowed, opposed side elements connected by opposed end elements. The inwardly bowed side elements are engaged by the detent cam and are displaced outwardly when the lock is actuated from one condition to another by rotation of the locking cam and its operating lever. In accordance with an aspect of the invention, the confining structure includes walls that closely confine the opposed end elements of the spring, as well as the four corners thereof, and thus substantially prevents separation of the end elements during the outward displacement of the bowed side elements. As the bowed side elements are displaced outwardly, they tend to become straighter and thus tend to force the end elements to separate. However, such separation is prevented by the confining structure. This places great stress on the side elements of the spring and greatly enhances the detent action thereof, enabling stronger and more effective spring action to be realized with the detent mechanism.

For a more complete understanding of the above and other features and advantages of the invention, reference should be made to the following detailed description of a preferred embodiment thereof and to the accompanying drawings.

DETAILED DESCRIPTION OF THE INVENTION

Figure 1:
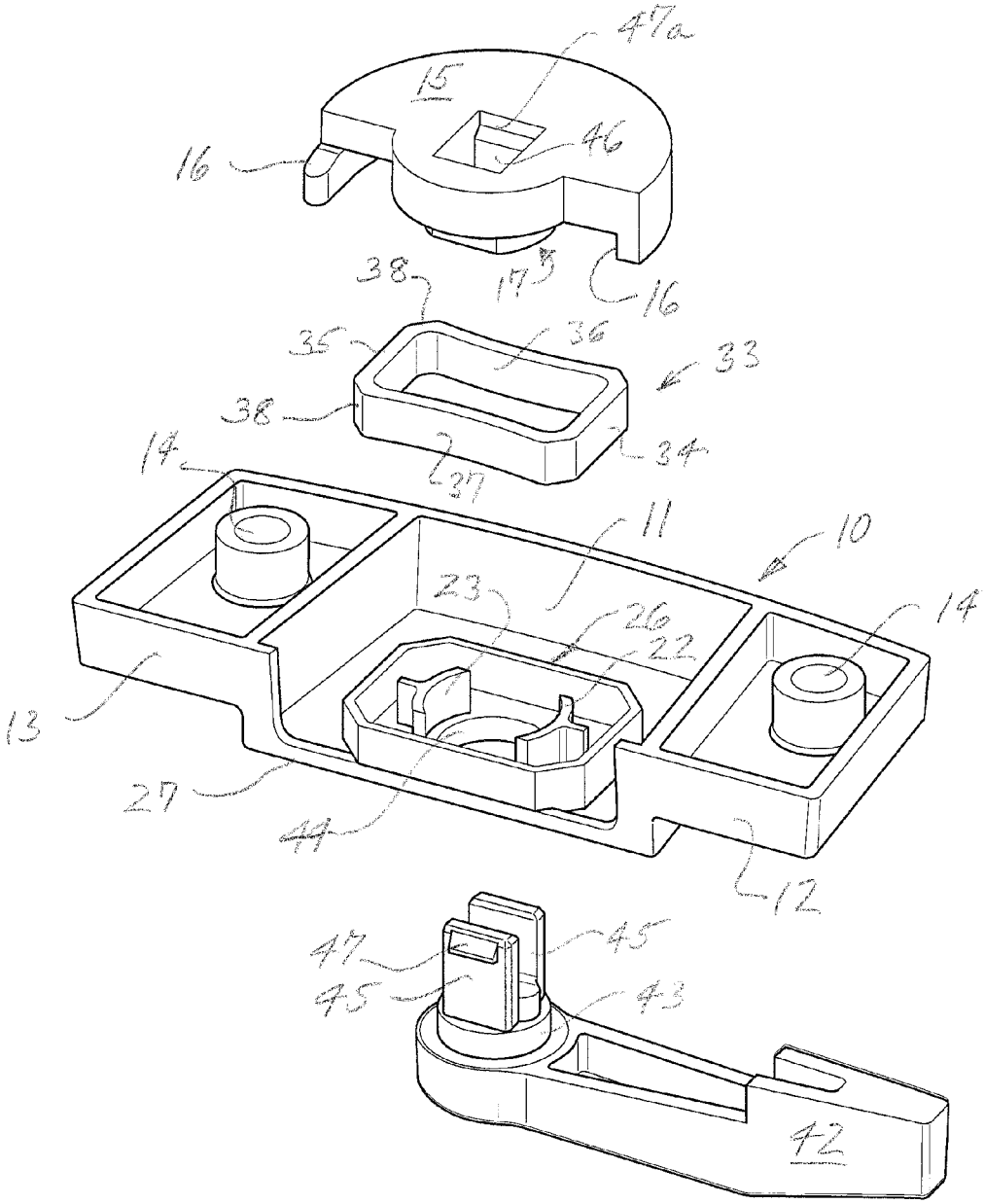
FIG. 1 is an exploded view of the lock part of a sash lock mechanism incorporating features of the invention.
Figure 2:
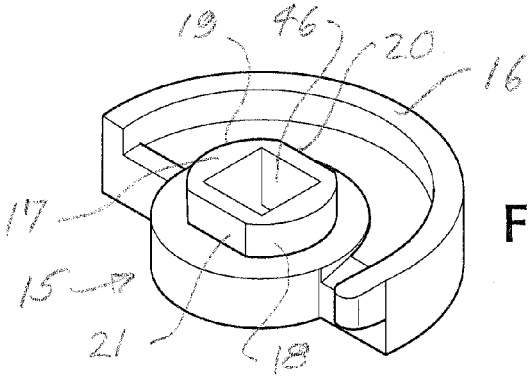
FIG. 2 is a perspective view of a locking cam incorporated in the sash lock mechanism of FIG. 1, with an integral detent cam associated therewith.
Figure 3:
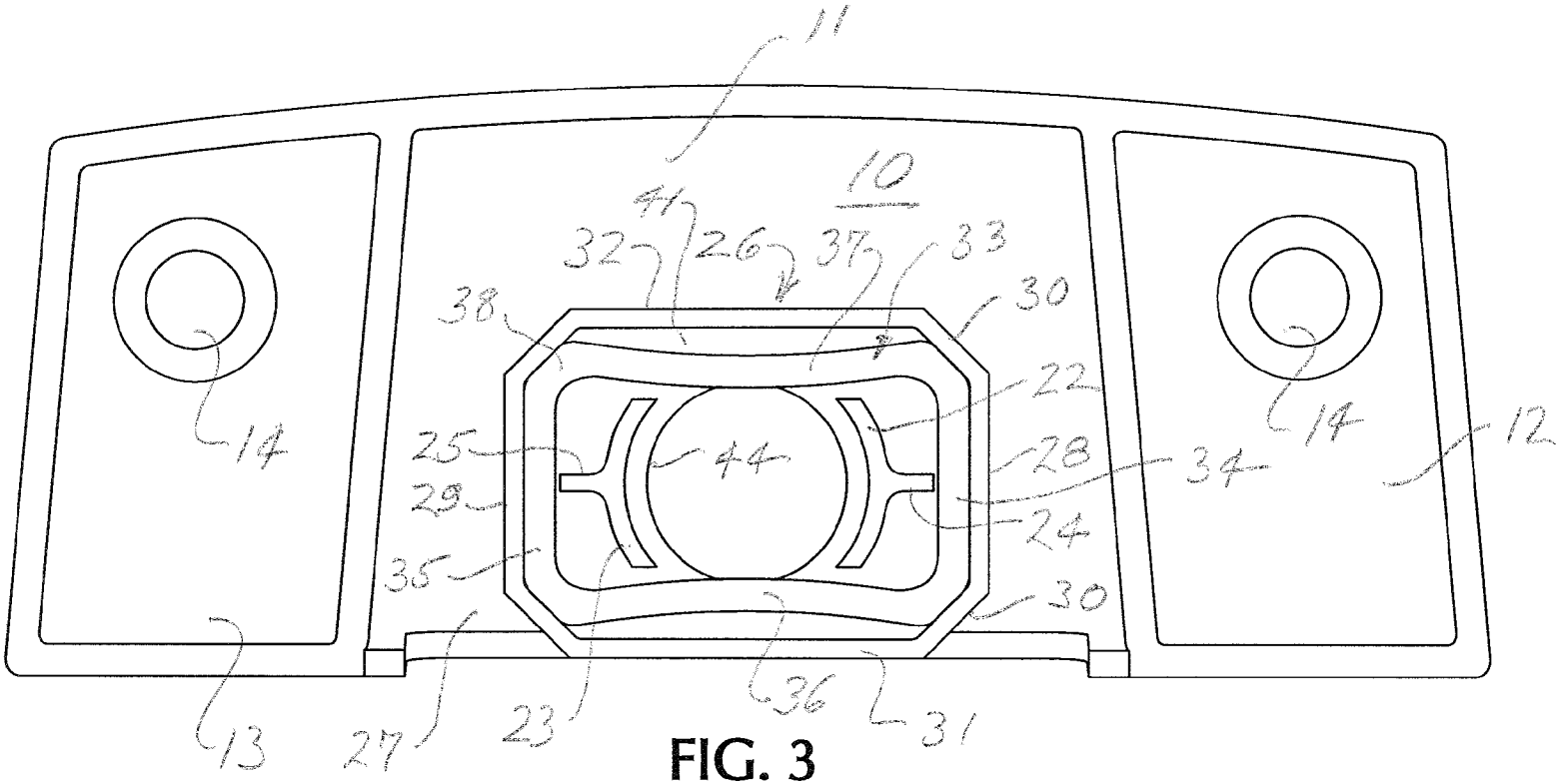
FIG. 3 is a bottom plan view of the sash lock mechanism of FIG. 1, with the locking cam and operating lever removed to enable internal details to be viewed.

Referring now to the drawings, and initially to FIGS. 1-3 thereof, the reference numeral 10 designates a sash lock housing, molded of plastic material and formed with a central cavity 11 and mounting wings 12, 13 at opposite ends. The mounting wings 12, 13 have openings 14 therein for the reception of mounting screws, whereby the housing may be fixed to the top rail of a lower window sash (not shown). As will be understood, a complete sash lock unit includes a keeper part (not shown) that is fixed to the lower rail of an upper window sash and cooperates in a well known manner with the lock part illustrated herein (e.g., see Chaput U.S. Pat. No. 5,741,032).

The mechanism of FIG. 1 includes a rotary locking cam 15, shown also in FIG. 2, which is generally semicircular in form and includes a semicircular lip flange 16 arranged to be rotated into engagement with the keeper part (not shown) of the lock unit. The locking cam 15 is integrally associated with a detent cam 17 which, in the illustrated embodiment, comprises opposed cylindrical portions 18, 19 separated by opposed flat surfaces 20, 21.

Figure 4:
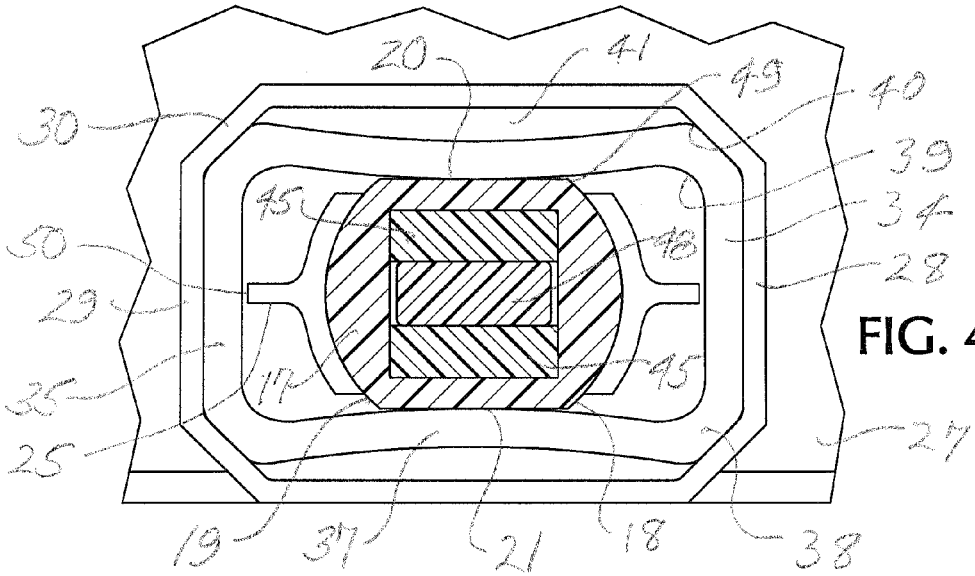
FIG. 4 is an enlarged fragmentary view, of the mechanism of FIG. 3 with the locking cam and operating lever in place and showing the latter in cross section through the detent cam, and with the detent cam and operating lever oriented as in their "lock" or "unlock" positions.
Figure 5:
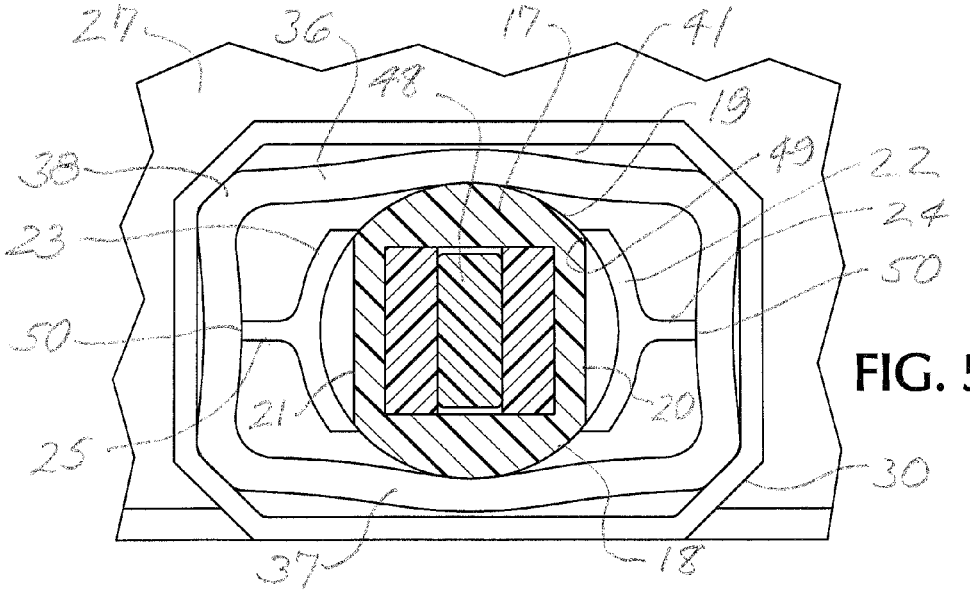
FIG. 5 is an enlarged, fragmentary view, similar to FIG. 4, but showing the detent cam and operating lever oriented as in an intermediate position.

As shown in FIGS. 3-5, the housing 10 includes integrally molded, arcuate bearing segments 22, 23 which extend downward from the upper wall 24 of the housing 10. The radius of the bearing segments 22, 23 corresponds with that of the cylindrical surfaces portions 18, 19 of the detent cam, such that the detent cam is supported by the arcuate bearing segments for rotation with respect to the housing 10. In the illustrated embodiment, the cylindrical surface portions 18, 19 may have a radius of 0.222 inch, and the inside surfaces of the bearing segments may have a radius of 0.232. Additionally, and as reflected in FIGS. 4 and 5, the arcuate bearing segments 22, 23 subtend angles greater than the angles subtended by the flat surfaces 20, 21 of the detent cam. By way of example, in the illustrated mechanism, the arcuate bearing segments 22, 23 subtend and angle of about 83°. The flat surfaces 20, 21 of the detent cam subtend and angle of about 65°. The arrangement is such that, in all rotary positions of the detent cam 17 relative to the arcuate segments 22, 23, the arcuate segments are in contact with portions of the cylindrical surfaces 18, 19. This structure (in itself known and forming no part of the invention) provides a continuity of bearing support in all rotary positions of the detent cam 17.

In the illustrated form of the invention, the arcuate bearing segments 22, 23 are integrally joined with radially extending support elements 24, 25, in somewhat of a "Y" configuration. These support elements add rigidity to the arcuate segments to assist in the rotatable support and retention of the locking cam 15. They also, as will be later described, cooperate with the detent spring in a manner to enhance the desired detent positioning action of the new mechanism.

With reference to FIG. 3-5, the housing 10 is formed with a detent confinement wall 26, which is integrally molded with, and depends downward from, the housing top wall 27. In the illustrated embodiment, the confinement wall 26 forms a continuous enclosure, comprised of opposed end walls 28, 29, corner walls 30, and opposed front and back side walls 31, 32. The corner walls 30 advantageously are disposed at about 45° with respect to the side and end walls. The height of the confinement wall is substantially less than that of the housing cavity 11. For example, whereas the cavity 11 may have a typical height of about ⅜ inch, the height of the confinement wall may be approximately 0.165 inch. This provides room for the locking cam 15 to be received underneath the confinement wall, as reflected in FIG. 1. The confinement wall 26, although relatively thin (for example 0.035 in) has substantial rigidity by virtue of its angular, preferably closed, configuration.

In accordance with the invention, a novel form of detent spring 33 is received within the confinement wall 26, in a close-fitting relation to the end and corner walls 28-30 thereof. The detent spring 33 is an injection molding of an engineering plastic material. Celcon®, which is an acetal copolymer (polyoxymethylene) produced by Ticona Engineering Polymers, of Florence, Ky., is a preferred material because of its strength and resilience, and its ability to retain those characteristics over time. The detent spring 33, shown in detail in FIGS. 3-5, is generally in the form of a closed rectangle preferably with relatively straight end elements 34, 35 joined by side elements 36, 37 and angled corner elements 38. For a typical sash lock, the elements of the detent spring 33 may have a thickness of about 0.060 inch and a height of about 0.165 inch, the height corresponding generally to that of the confining wall 26.

Importantly, the opposed side elements 36, 37 are bowed inwardly, when in an unstressed condition, as shown in FIG. 3. In a preferred embodiment, the inner surfaces of the side elements may be formed on a radius of about two inches. The two end elements 34, 35 have a normal spacing that provides a close fit against the inner surfaces of the confining end walls 28, 29. In one preferred embodiment, the spacing between outer surfaces of the spring end elements 24, 25 may be 0.835 inch, while the spacing between inner surfaces of the end walls 29, 29 may be 0.840 inch. In a similar manner, the corner elements 38 of the detent spring 33 are disposed at substantially the same angle as the corner walls 30 of the confinement wall 26 and the respective corner areas are so dimensioned and configured that the corner elements 38 are closely confined by the corner walls 30. The insides 39 of the corner elements preferably are generously rounded. In the illustrated embodiment the corner insides 39 are formed on a radius of about 0.063 inch. The corner elements 38 can also be rounded slightly (e.g., on a radius of about 0.047 inch) at their opposite ends 40, where they join with the end and side elements 34-37.

As shown in FIG. 4, the external ends of the detent spring 33, including the corner areas, are slightly shorter than the corresponding end walls and corner areas of the confining wall 26. For example, the dimensions of the spring end wall structure, between the outermost corners may be about 0.530 inch, whereas the dimension between inner side walls 31, 32 of the confinement wall may be about 0.585 inch. This provides for small clearance spaces 41 between the side elements 36, 37 of the detent spring and the front and back side walls 31, 32 of the confinement wall 26. The clearance spaces 41 allow for the elastic outward deflection of the side elements of the detent spring, when the lock mechanism is actuated from one position to another.

When the locking cam 15 is assembled with the housing 10, the flat sides of the detent cam 17 are pressed between the side elements 36, 37 of the detent spring, slightly spreading those elements. In this respect, the spacing between the two side elements 36, 37, when at rest, preferably is about 0.020 inch less than the spacing between the two flat surfaces, 20, 21 of the detent cam which, in the illustrated embodiment, is 0.355 inch. Thus, when the detent cam is in the orientation shown in FIG. 4, the detent spring 33 is slightly stressed, in a manner to retain the detent cam 17 (and therefore the locking cam 15) in the illustrated rotational orientation.

An operating lever 42 is assembled with the housing 10 from the top. The lever 42 has a bearing collar 43, which is closely received in a guide opening 44 in the top wall of the housing 10 to rotationally support the lever. Spaced apart legs 45, extend downward from the bearing collar 43 and are received within a rectangular opening 46 in the locking cam 15. Each leg is provided with a locking rib 47 at its lower end, which is received in a recess **47*a* provided in the walls of the opening 46. The arrangement is such that when the operating lever 42 is assembled with the locking cam 15, the two elements will not readily separate. Additionally, a wedge element 48 (FIG. 4) can be inserted into the space between the two legs 45, so that the operating lever 42** can be disassembled from the housing only by gaining access to the underside of the housing.

In the rotational orientation of the components illustrated in FIG. 4, the operating lever would be in either a "unlock" or a "lock" position, with the detent spring 33 pressing snugly against the opposite side flat surfaces 20, 21 of the detent cam 17. When the operating lever 42 is manipulated from one position to the other, the detent cam 17 passes through a mid-position, illustrated in FIG. 5. In that orientation, the flat surfaces 20, 21 of the detent cam have been rotated 90° and have been centered with respect to the bearing segments 22, 23. During this 90° rotation, the side elements 36, 37 of the detent spring are displaced outwardly, from the inwardly bowed configuration of FIG. 4 to the somewhat outwardly bowed configuration of FIG. 5.

As will be understood, when the side elements 36, 37 of the detent spring are deflected to a somewhat outwardly bowed configuration, they will at first try to assume a somewhat straight condition, which requires an outward movement of the end elements 34, 35. However, such an outward movement is prevented by the close containment of the end elements by the confining end walls 28, 29 and the confining corner walls 30. The confinement of the end elements 34, 35 against outward movement causes the detent spring to exert a far greater level of resistance to displacement, and a correspondingly greater return force, than if the spring were not confined in the manner described. The net result is that the action and effect of the spring is significantly magnified in relation to its normal elastic characteristics.

As the side elements 36, 37 of the detent spring are displaced to the outwardly bowed condition shown in FIG. 5, the laterally confined end elements 34, 35 will tend to be pivoted inwardly about their respective outermost corners and thus to assume an inwardly bowed configuration. In accordance with one aspect of the invention, however, the support elements 24, 25, which extend laterally from the arcuate bearing segments 22, 23, are arranged with their ends 49, 50 positioned in closely spaced relation (e.g., within about 0.010 inch) to the inside surfaces of the end elements 34, 35. This serves to substantially limit or prevent the inward bowing of the end elements 34, 35 that otherwise would occur, and this further magnifies the effective strength of the detent spring 33 and enhances the strong snap action effect as the detent cam 17 rotates toward its final positions, in which flat surfaces 21, 22 of the detent cam are re-engaged by the side elements of the detent spring.

In the orientation of parts shown in FIG. 5, the operating lever 42 is positioned midway between "lock" and "unlock" positions, with the detent spring exerting a maximum force on the detent cam, but not tending to rotate the cam because the detent spring is acting on the cylindrical surface portions 18, 19, of the cam. However, after the detent cam and lever 42 have been rotated part way to the new position, the centers of the spring elements 36, 37 will be engaged by the corner areas 49, where the flat surfaces 20, 21 meet the cylindrical surfaces, 18, 19, of the detent cam. From this point onward, with continued rotation of the operating lever, the detent spring 33 will exert a strong turning moment on the detent cam 17, urging it and the operating lever 42 into the final "lock" or "unlock" position. Because of the greatly magnified, effective force of the detent spring, the operating lever is forcibly moved into its final position with a strong snap-action, which gives the lock a firm action and a desired feel.

The device of the invention enables a sash lock device to be all-plastic in construction, including the detent spring, while obtaining a level of performance which heretofore has been characteristic of sash locks using mostly plastic construction but maintaining the use of metallic detent springs in order to achieve the desired strong, snap-action feel when operating the lock. The present invention provides a high-performance plastic detent spring in which the action of the spring is greatly enhanced and magnified by the unique geometry of the detent spring and the manner in which the spring is mounted and confined within the sash lock housing. This is derived from the generally rectangular form of the detent spring, with its opposed, inwardly bowed side elements connected by end elements, where the end elements are both confined against outward displacement by the confining side walls 28, 29, and against inward bowing by the end surfaces 50 of the bearing supports 24, 25. This structure causes greater stressing of the side elements of the detent spring and significantly magnifies their resistance to outward displacement and correspondingly magnifies the effective return force of the spring in relation to that which would be expected from the characteristics of the plastic material when configured in more conventional spring forms.

With the mechanism of the invention metallic springs can be replaced with the new form of plastic spring, providing equal or better functionality and at the same time reducing the cost of manufacture. Among other things, the rectangular detent spring is easily installed within its confinement wall 26 without requiring the spring to be stressed in order fit within the containment. Thereafter the detent cam 17 is easily inserted from below between the side elements 36, 37 of the spring 33. The assembly is easier and more economical than if conventional metallic spring elements are installed.

It should be understood, of course, that the specific preferred embodiments of the invention illustrated and described herein are intended to be representative only, and not by way of limitation, as variations may be made therein without departing from the clear teachings of the invention. Accordingly reference should be made to the following appended claims in determining the full scope of the invention.

What is claimed is:

1. In a window sash lock of the type having a housing adapted for mounting on an upper rail of a window sash and having a cavity therein, a rotatable locking member received in said cavity for rotational movement, an operating lever mounted at a top of said housing, passing through an upper wall of said housing and connected to said locking member underneath said upper wall for effecting rotation of said locking member, said locking member including a partially cylindrical detent cam rotatably engaged and supported by a partially cylindrical bearing portion associated with said housing, said partially cylindrical detent cam having opposed cylindrical surface portions separated by opposed recessed portions forming opposed detent surfaces, said partially cylindrical bearing portions comprising opposed arcuate bearing surfaces positioned to engage and rotatably support opposite sides of said partially cylindrical detent cam, said opposed arcuate bearing surfaces having an arcuate extent such that said rotary locking member is rotatably supported by said arcuate bearing surfaces in all rotary positions of said locking member, and a detent member acting in a space between said opposed arcuate bearing surfaces with a resilient force directed radially inward toward an axis of said partially cylindrical detent cam and positioned be bear against said detent surfaces to releasably retain said rotary locking element in predetermined "lock" or "unlock" positions, the improvement characterized by said detent member comprising a one-piece detent spring of closed configuration, having side elements and end elements defining an open center portion, said detent spring being formed of a resilient plastic material and having spaced-apart, opposed side elements and spaced-apart, opposed end elements integrally connected at ends thereof to respective ends of said side elements, said detent spring being positioned in surrounding relation to said partially cylindrical detent cam, said housing having locating walls, associated with said cavity, engaging and fixing the location of said detent spring with respect to said cavity and with respect to said partially cylindrical detent cam, said spaced-apart side elements having contact portions spanning the spaces between said arcuate bearing surfaces and resiliently engaging opposite outer surface portions of said partially cylindrical detent cam in said spaces, said side elements being configured in a normally inwardly bowed shape, with center portions thereof comprising said contact portions and positioned to engage said opposed detent surfaces when said detent cam is in said "lock" or "unlock" positions, said contact portions being outwardly resiliently displaced by said detent element from said inwardly bowed configuration to an outwardly bowed configuration during rotation of said detent cam between said "lock" and "unlock" positions and functioning, when not so resiliently displaced, to retain said detent element in said "lock" or "unlock" positions, said locating walls including wall portions positioned to engage surfaces of the end elements of said detent spring to limit outward separating movement of said end elements during outward displacement of the contact portions of said side elements.

2. A sash lock according to claim 1, wherein said detent spring has corner areas at which end portions of said end elements join with end portions of said side elements, and said locating walls include portions engaging external surfaces of said corner areas to restrict movement thereof in a direction to outwardly separate the end portions of the respective end elements.

3. A sash lock according to claim 2, wherein said locating walls further include portions positioned closely adjacent inside surface portions of said end elements, in center regions thereof, to restrict inward deflections of said center regions during outward displacement of the contact portions of said side elements.

4. A detent mechanism for a sash lock of the type having a base, a rotatable lock member mounted in said base, a detent cam associated with said rotatable lock member, and a resilient detent spring acting on said detent cam to releasably retain said rotary lock member in predetermined "lock" and "unlock" positions with respect to said housing, wherein said resilient detent spring comprises a one-piece element molded of resilient plastic material and having a closed configuration formed by spaced apart, opposed side elements, and spaced apart, opposed end elements integrally joined with opposite ends of said side elements, said detent spring defining a central open space, said detent cam being received within the central open space of said resilient detent spring, said side elements being configured in a normally inwardly bowed shape, with center portions thereof comprising contact portions and being positioned to engage opposed surfaces of said detent cam when said detent cam is in said "lock" or "unlock" positions, locating members on said housing engaging and fixing the location of said detent spring with respect to said housing and said detent cam and closely confining said end elements against outward movement in a first direction, said detent cam having opposed detent areas engaging said contact surfaces when said rotary locking member is in a "lock" or "unlock" position with respect to said housing, said detent cam having opposed displacement surfaces located between said detent areas and configured to outwardly resiliently displace said contact surfaces and said side elements in a second direction at right angles to said first direction when said rotary locking member and detent cam are being rotated between "lock" and "unlock" positions, and said displacement surfaces, during rotation between said "lock" and "unlock" positions, being functional to invert the side elements of said detent spring from said inwardly bowed configuration to an outwardly bowed configuration.

5. A detent mechanism according to claim 4, wherein said detent spring is of generally rectangular shape and has corner areas where ends of said side elements integrally join with said end elements, and said locating members include elements on said housing engaging and positioning said corner areas to restrict outward displacement of said corner areas in said first direction when said contact areas are displaced outwardly in said second direction by said detent cam.

6. A detent mechanism according to claim 5, wherein said locating members include first locating elements positioned externally of said detent spring to restrict motion of said end elements in a separating direction, and second locating elements positioned internally of said detent spring and closely adjacent to center portions of said end elements to restrict inward movement of said center portions during outward displacement of said side elements.

7. A detent mechanism according to claim 5, wherein said corner areas of said detent spring comprise short corner elements disposed at an angle to each of the side elements and end elements, and said locating members include surfaces positioned closely adjacent to or in contact with outer surfaces of said corner elements.

8. A detent mechanism according to claim 4, wherein said locating members are formed in part by a substantially continuous confinement wall fixed to said housing and surrounding said detent spring and having confinement end wall portions contacting external surfaces of the end elements of said detent spring, and said confinement wall includes spaced apart confinement side wall portions extending between said confinement end wall portions and spaced outward from the side elements of said detent spring to accommodate outward bowing of the side elements of said detent spring.

9. A detent mechanism according to claim 8, wherein said locating members include elements located adjacent internal surfaces of the end elements of said detent spring to restrict inward displacement of center portions thereof during outward displacement of the side elements of said detent spring.

10. A detent mechanism for a sash lock of the type having a housing, a rotatable lock member mounted in said housing, a detent cam associated with said rotatable lock member, and a resilient detent member acting on said detent cam to releasably retain said mechanism in predetermined "lock" and "unlock" positions with respect to said housing, wherein said resilient detent member comprises a one-piece detent spring molded of resilient plastic material and having a closed, generally rectangular configuration formed by spaced apart, opposed side elements, and spaced apart, opposed end elements integrally connecting opposite ends of said side elements at corner regions and defining a central open space, said detent cam being received within the central open space of said detent spring and being mounted for rotation on a fixed axis extending through said central open space, locating members on said housing engaging said detent spring at end wall and/or corner regions thereof and fixing the location of said detent spring with respect to said housing and said detent cam and limiting laterally outward movement of said end wall and/or corner regions, while accommodating flexing of said side elements, said opposed side elements having a normally inwardly bowed configuration, with central portions thereof forming contact surfaces engageable with said detent cam, said detent cam having at least one detent area engageable with at least one of said contact surfaces when said rotary locking member is in a "lock" or "unlock" position with respect to said housing, to releasably retain said detent cam and said rotary lock member in said "lock" or "unlock" positions, and said detent cam having displacement surfaces in one or more regions adjacent to opposite sides of said at least one detent area which are configured to outwardly resiliently displace at least one of said contact surfaces and said side elements to an outwardly bowed configuration when said rotary locking member and detent cam are rotated through intermediate positions between said "lock" and "unlock" positions.

11. A detent mechanism according to claim 10, wherein, said locating members further include elements engagable with internal surfaces of said end elements in central regions thereof to restrict inward movement of said central regions in a direction toward said fixed axis.

12. A detent mechanism according to claim 10, wherein said detent spring is an injection molding of an acetal copolymer (polyoxymethylene) plastic material.

* * * * *